US005154781A

United States Patent [19]

Catellier

[11] Patent Number: 5,154,781

[45] Date of Patent: Oct. 13, 1992

[54] METHOD TO MAKE CASTING ALLOY GOLF CLUBS

[75] Inventor: Allan T. Catellier, Thousand Oaks, Calif.

[73] Assignee: Wilson Sporting Goods Co., River Grove, Ill.

[21] Appl. No.: 705,356

[22] Filed: May 30, 1991

[51] Int. Cl.[5] ..... C21D 6/00

[52] U.S. Cl. ..... 148/542; 148/548

[58] Field of Search ..... 420/61; 148/325, 542, 148/548

[56] References Cited

U.S. PATENT DOCUMENTS

| | | | |
|---|---|---|---|
| 2,775,520 | 12/1956 | Bloom et al. | 420/42 |
| 3,082,082 | 3/1963 | Bidwell et al. | 420/61 |
| 3,362,813 | 1/1968 | Ziolkowski | 420/41 |
| 3,563,729 | 4/1968 | Kovach et al. | 420/42 |
| 3,567,434 | 3/1971 | Richardson et al. | 420/61 |
| 3,912,503 | 10/1975 | Schumacher et al. | 420/42 |
| 3,989,248 | 11/1976 | Campau | 273/78 |
| 4,125,260 | 11/1978 | Kanne et al. | 273/80 R |
| 4,139,196 | 2/1979 | Riley | 273/164 |
| 4,169,595 | 10/1979 | Kaugars | 273/80 R |
| 4,330,126 | 5/1992 | Rumble | 273/80 R |
| 4,340,432 | 7/1982 | Hede | 419/42 |
| 4,461,479 | 7/1984 | Mitchell | 273/81 A |
| 4,832,765 | 5/1989 | DeBold | 148/325 |

FOREIGN PATENT DOCUMENTS 2348292 12/1974 Fed. Rep. of Germany .

OTHER PUBLICATIONS

Fontana, "New High-Strength Stainless Steel" I/EC Corrosion, Alloy Casting Institute, Mineola N.Y., Apr. 11, 1957.

*Primary Examiner*—Deborah Yee

*Attorney, Agent, or Firm*—Tilton, Fallon, Lungmus & Chestnut

[57] ABSTRACT

This invention relates to a duplex stainless steel alloy useful in the manufacture of noncorrosive golf club irons and metal woods. A golf club made with this new alloy has improved corrosion resistance, appropriate hardness for the intended use, superior mechanical strength, increased abrasive wear, durability, improved manufacturability, and increased feel over golf clubs made with conventional alloys.

2 Claims, No Drawings

METHOD TO MAKE CASTING ALLOY GOLF CLUBS

BACKGROUND OF THE INVENTION

1. Field Of The Invention

This invention relates to a duplex stainless steel alloy useful in the manufacture of noncorrosive golf club irons and metal woods.

2. Description Of The Prior Art

Previously four steel alloys have been used for golf clubs. They are: Low alloy steels (1020, 8620), 431 stainless steel, 300 series stainless steels, and 17-4 PH stainless steel. All of these alloys, however, have certain characteristics that make them less than ideal golf club alloys. In particular, the stainless steels either have little or insufficient corrosion resistance or the alloy is soft and requires straightening on a regular basis.

SUMMARY OF THE INVENTION

In accordance with this invention, a duplex stainless steel alloy is provided consisting essentially of about:

| Element | Weight Percent |
|---|---|
| C | 0.05 max. |
| Mn | 1.0 max. |
| Si | 1.0 max. |
| Cr | 24 to 27 |
| Ni | 4 to 7 |
| Mo | 1 to 3 |
| Cu | 2 to 3 |
| P | 0.05 max. |
| S | 0.05 max. |
| N | 0.20 max. |

The balance of the alloy being comprised of iron.

The composition of this invention is useful for a golf club casting alloy. A golf club made with this alloy has improved corrosion resistance, superior mechanical strength, adequate hardness for a variety of applications and improved manufacturability.

In particular, this invention provides a corrosion resistant golf club wherein the club has a Rockwell C hardness of between about 22–33. This invention provides a method to make a corrosion resistant golf club iron by casting the above discussed alloy to an as-case Rockwell C hardness of between about 22 to 26. Additionally, this invention provides a method to make corrosion resistant golf club metal woods by casting the above discussed alloy and heat treating said alloy to a Rockwell C hardness range of between 22 to 33.

DETAILED DESCRIPTION OF THE INVENTION

The present invention relates to the application of a duplex alloy in the manufacturing of golf club heads with the benefit of improved corrosion resistance, superior mechanical properties, hardness within the appropriate range for intended use, increased feel and improved abrasion resistance.

Golf club heads are made by casting or forging. The physical properties of a golf club head relate to the alloy selected and the properties may also be influenced by heat treatment conditions. In the present invention, the alloy selected is a duplex; a duplex is an alloy that can be heat treated or not heat treated, depending on the particular properties desired in the finished product. In particular, the alloy found to be the most suitable is a modification of the alloy CD-4MCu. CD-4MCu is made up of the following formula:

| Element | Weight Percent |
|---|---|
| C | 0.01 max. |
| Mn | 1.0 max. |
| Si | 1.0 max. |
| Cr | 24 to 27 |
| Ni | 4 to 7 |
| Mo | 1 to 3 |
| P | 0.05 max. |
| S | 0.05 max. |
| Cu | 2 to 5 |
| N | 0.032 max. |
| O | 0.028 max. |
| Fe | Balance |

The alloy of the present invention is a duplex alloy derived from CD-4MCu (ASTM A743) made up of the following formula:

| Element | Weight Percent |
|---|---|
| C | 0.05 max. |
| Mn | 1.0 max. |
| Si | 1.0 max. |
| Cr | 24 to 27 |
| Ni | 4 to 7 |
| Mo | 1 to 3 |
| Cu | 2 to 3 |
| P | 0.05 max. |
| S | 0.05 max. |
| N | 0.20 max. |

The balance of the alloy being comprised of iron.

The alloy of the present invention differs from CD-4MCu in that it has a tighter specification for copper, a higher allowance for carbon, and a higher allowance for nitrogen. Additionally, it was found that oxygen was an optional component depending on the casting process employed. A golf club made with this alloy has improved corrosion resistance, superior mechanical strength, adequate hardness for a variety of applications and improved manufacturability.

The physical properties that are important for a golf club include: corrosion resistance, hardness, mechanical strength, abrasive wear resistance, and certain aesthetic qualities such as increased feel.

Corrosion resistance is determined according to federal specification QQ-P-35B; that is, a test for passive treatments for corrosion-resisting steel. The procedure specifies that "the cleaned and dried parts shall be subjected to 95–100 percent humidity at 100°–115° F. in a suitable humidity cabinet for 24–26 hours." Another test for corrosion resistance is the salt spray (Fog) test ASTM-B117.

Hardness is another important physical property of a golf club. Hardness is determined by the Rockwell hardness test using either the B or C scale. As the hardness of the formed club varies different applications, such as a metal wood or iron, are available.

Another important physical property is mechanical strength. To be useful as a golf club, the alloy must provide mechanical strength. The tests to determine mechanical strength include Ultimate Tensile Strength, Yield Strength, and Percent Elongation.

Another related mechanical property is durability. A golf club made of a new alloy must meet a minimum durability requirement. Presently, the minimum durability requirement is no failures within a three year cycle (BTM 040 3 years impact).

Another important physical property is the formed club's ability to resist abrasive wear. The Abrasive Wear Test ASTM No. G65 involves a dry-sand/rubber-wheel test of metals for scratching abrasion.

An equally important aspect of any golf club is its aesthetic properties such as feel and the overall general appearance. In golf, a good player likes to "feel the ball" as the club strikes the ball. Players compare clubs by finding that one club versus another club has increased or decreased feel. To be considered a superior club, a finding of increased feel is important.

Another important factor is the general overall appearance of the club. This subjective evaluation is closely related to the previously discussed concept of corrosion and abrasion resistance; that is a golf club with corrosion or abrasion marks would not have a good general overall appearance.

A golf club, either a metal wood or iron, can be made according to the following process. The melting point of the alloy of this invention is 2600° F. Thus, a pouring temperature of 2850° F. to 2900° F. should provide adequate fill. There is no need to degas the alloy as soluble gas defects are virtually nonexistent. Due to the critical nature of the appearance of the surface of the club in golf, it is suggested that a slag coagulant "grip" be employed. That is, a formulated sand is added to the molten composition to precipitate slag. The slag is removed prior to pouring the mold. This coagulant should be applied approximately three times with special care given after the last application for complete removal of the slag.

Pouring should be accomplished at a rate commensurate with maximum filling rate and lamellar flow. Post-pouring practice does not require "canning", although for maximum surface cleanliness and ease of finishing it is suggested. Canning involves placing a can over the top of the mold with an oxygen consuming substance in the can.

The alloy of this invention is normally used in the solution annealed condition, but it can be precipitation hardened for carefully selected applications when lower corrosion resistance can be tolerated and when there is no potential for stress corrosion cracking.

The alloy of this invention is the most highly alloyed material in the duplex group of alloys, and a microstructure containing approximately equal amounts of ferrite and austenite is common. The low carbon content and high chromium content render the alloy relatively immune to intergranular corrosion. High chromium and molybdenum provide a high degree of localized corrosion resistance (to crevices and pitting) and the duplex micro structure provides stress corrosion cracking resistance in many environments. This alloy can be precipitation hardened to provide strength and is also relatively resistant to abrasion and erosion.

Additionally, it was found that the hardness of the alloy could be increased to about 33 (Rockwell C) by heat treatment. See Table 1. A golf club head in the range of between 22 to 33 (Rockwell C) hardness can be used as a metal wood. It should be recognized that nonheat-treated alloys in the range of 22 to 26 hardness (Rockwell C) can function as irons.

Testing of golf clubs made from this alloy provided the following results: The clubs meet minimum durability requirements (BTM 040 3 years impact). The other mechanical properties are shown in Table 1. From this it can be seen that Rockwell C hardness ranges from about 22 to 33 depending on whether the alloy is heat treated. The Ultimate Tensile Strength ranges from about 139,000 to 100,000 pounds per square inch. The Yield strength ranges from about 114,000 to 70,000 pounds per square inch. The Elongation ranges from 15 to 19% and the Reduction of Area Ranges from about 39 to 25%. It should be understood tat the preferred mechanical properties directly relate to the intended use of the clubs as a metal wood or iron. Indeed one of the advantages of the alloy of this invention is the ability to obtain clubs having different physical properties within the above specified ranges.

TABLE 1

Mechanical Properties v. Heat Treatment

| Heat Cycle | Cast 1 Hr. 2050° F. Water Quench 3 Hrs. 925° F. Air Cool | Cast 1 Hr. 2050.F Cool to 1750° F. Water Quench 3 Hrs. 925° F. Air Cool | Cast 2 Hrs. 1350° F. Air Cool | Cast 3 Hrs. 925° F. Air Cool |
|---|---|---|---|---|
| Ultimate Tensile Strength - PSI | 139,000 | 132,000 | 109,000 | 128,000 |
| Yield - PSI | 114,000 | 99,000 | 78,000 | 102,000 |
| % Elongation | 15 | 17 | 18 | 19 |
| % Reduction of Area | 34 | 34 | 25 | 39 |
| Rockwell "C" Hardness | 33 | 30 | 25 | 29 |

Golf clubs made with prior alloys having approximately the following mechanical properties:

| Alloy | Tensile(psi) | Yield(psi) | % Elongation | Hardness |
|---|---|---|---|---|
| 304 | 70,000 | 30,000 | 35 | Rb 88 |
| CD-4MCu | 100,000 | 70,000 | 16 | Rc 23 |
| 17-4 PH | 115,000 | 75,000 | 18 | Rc 26 |

A golf club made with the alloy of this invention also has increased manufacturability. In particular, finishing tests have shown that clubs made of the alloy of this invention work nicely. Material is removed with little effort by belt sanding and buffing. Additionally, it has been observed that the belts are not loaded with fines after finishing, resulting in manufacturing cost savings in belt replacement.

Additionally, salt spray testing (ASTM B117) and corrosion resistance testing was conducted on a club formed with the alloy of this invention and a club made from 17-4 PH. 17-4 PH is the standard alloy used in golf clubs. In the salt spray fogging test steel parts are passivated in an aqueous solution of nitric acid and sodium dichromate and then subjected to a salt spray test. Samples of the metal are visually inspected for resulting defects such as etching, pitting or frosting. In a comparison of 17-4 PH and the alloy of this invention, it was found that the corrosion resistance of 17-4 PH was poor, while the corrosion resistance of the alloy of this invention was determined to be excellent based on a visual inspection of the metal parts tested.

The alloy of this invention has considerably more oxidation resistance as compared to 17-4 PH, thus expect a much more aesthetically pleasing surface. Clubs made with the alloy of this invention combine high mechanical strength, ductility and hardness with excellent resistance to corrosion and erosion.

For clubs made with the alloy of this invention, corrosion resistance under most conditions of service is superior to that of fully austenitic stainless steels which are the highest in corrosion resistance of all stainless steels present on the market today. This means that clubs made with the alloy of this invention are more corrosion resistant than 304, 316, and 317L. (In golf this would mean much better resistance than any 17-4 or 18-8 used today.)

Field tests of clubs made with the alloy of this invention provided the following data:

In the field trial, players have over ten rounds of golf on the irons, and many hits on the practice range. Players have commented that the new finish/material had a much improved appearance compared with the standard production irons. The finish has held up very well in play. There are the expected few scratches on the faces and sole plates, but are hardly noticeable.

The players agree that the irons feel softer than the standard stainless steel material of cast irons. The players believe that the clubs do not feel quite as soft as forged clubs however.

Additionally, two sets of metal woods made from the alloy of this invention are in play. The players report that they like the look and feel of the woods, all the finishes of the woods are holding up well after about five rounds each.

The above description of the invention is given only for purposes of illustrating the methods of the present invention, the scope of which is detailed in the following claims.

I claim:

1. A method to make a golf club head having improved corrosion resistance and ultimate tensile strength in the range of about 100,000 to 139,000 PSI and yield strength in the range of about 70,000 to 114,000 PSI which comprised the steps of:

a) casting a duplex stainless steel alloy consisting essentially of about:

| Element | Weight Percent |
|---|---|
| C | 0.05 max. |
| Mn | 1.0 max. |
| Si | 1.0 max. |
| Cr | 24 to 27 |
| Ni | 4 to 7 |
| Mo | 1 to 3 |
| Cu | 2 to 3 |
| P | 0.05 max. |
| S | 0.05 max. |
| N | 0.20 max. |

in the shape of a golf club head, b) heat treating said golf club head to obtain a Rockwell (c) hardness in the range of about 22 to 23.

2. A method to make a golf club head having improved corrosion resistance and ultimate tensile strength in the range of about 100,000 to 139,000 PSI and yield strength in the range of about 70,000 to 114,000 PSI which comprised the step of:

a) casting a duplex stainless steel alloy consisting essentially of about:

| Element | Weight Percent |
|---|---|
| C | 0.05 max. |
| Mn | 1.0 max. |
| Si | 1.0 max. |
| Cr | 24 to 27 |
| Ni | 4 to 7 |
| Mo | 1 to 3 |
| Cu | 2 to 3 |
| P | 0.05 max. |
| S | 0.05 max. |
| N | 0.20 max. |

in the shape of a golf club head, said golf club head having a Rockwell (c) hardness in the range of about 22 to 26.

* * * * *